US006167374A

United States Patent [19]

Shaffer et al.

[11] Patent Number: 6,167,374

[45] **Date of Patent: *Dec. 26, 2000**

[54] SIGNAL PROCESSING METHOD AND SYSTEM UTILIZING LOGICAL SPEECH BOUNDARIES

[75] Inventors: Shmuel Shaffer, Palo Alto; Dan Lai, Los Altos; William J. Beyda, Cupertino, all of Calif.

[73] Assignee: Siemens Information and Communication Networks, Inc., Boca Raton, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/800,001

[22] Filed: Feb. 13, 1997

[51] Int. Cl.[7] ..... G10L 21/02

[52] U.S. Cl. ..... 704/227; 704/253

[58] Field of Search ..... 704/215, 241, 704/244, 243, 253, 232, 245, 226–228, 210; 375/233

[56] References Cited

U.S. PATENT DOCUMENTS

| | | | |
|---|---|---|---|
| 3,582,559 | 6/1971 | Hitchcock et al. | 704/253 |
| 4,247,947 | 1/1981 | Miyamoto | 455/517 |
| 4,707,858 | 11/1987 | Fette | 704/251 |
| 4,741,037 | 4/1988 | Goldstern | 704/226 |
| 4,761,796 | 8/1988 | Dunn et al. | 375/1 |
| 4,907,277 | 3/1990 | Callens et al. . | |
| 5,127,051 | 6/1992 | Chan et al. | 375/233 |
| 5,218,668 | 6/1993 | Higgins et al. | 704/200 |
| 5,222,190 | 6/1993 | Pawate et al. | 704/200 |
| 5,305,421 | 4/1994 | Li | 704/219 |
| 5,305,422 | 4/1994 | Junqua | 395/2.62 |
| 5,483,618 | 1/1996 | Johnson et al. | 395/2.79 |
| 5,546,395 | 8/1996 | Sharma et al. | 370/84 |
| 5,566,270 | 10/1996 | Albesano et al. | 395/2.41 |
| 5,579,436 | 11/1996 | Chou et al. | 704/244 |
| 5,592,586 | 1/1997 | Maitra et al. . | |
| 5,710,865 | 1/1998 | Abe | 704/248 |

FOREIGN PATENT DOCUMENTS

WO 93/17415 9/1993 WIPO .

OTHER PUBLICATIONS

Barron and Lockhart, "Missing Packet Recovery of Low–Bit–Rate Coded Speech Using a Novel Packet–Based Embedded Coder," Signal Processing V: Theories and Application, 1990, vol. 11, pp. 1115–1118.

*Primary Examiner*—David R. Hudspeth
*Assistant Examiner*—Donald L. Storm

[57] ABSTRACT

A method and system of processing speech information includes segmenting the speech information based upon detection of logical speech boundaries, such as isolated words, prior to compressing and/or transmitting the speech information. In one embodiment, a continuous stream of voice data is analyzed to detect signal segments containing the characteristics of an isolated word, thereby forming frames of speech information. The frames are data compressed to form packets that are transmitted to a remote site. Preferably, the packets include error checking information. In a receive mode, incoming packets are error checked prior to packet decoding. If transmission errors are detected, repairable packets may be corrected. Non-correctable errors cause generation of notice data that are used to notify a listener of the location of lost speech information. Notice data are also generated if the duration between two arriving packets exceeds a preselected threshold.

17 Claims, 4 Drawing Sheets

SIGNAL PROCESSING METHOD AND SYSTEM UTILIZING LOGICAL SPEECH BOUNDARIES

BACKGROUND OF THE INVENTION

The invention relates generally to signal processing of speech information and more particularly to processing voice data for division into segments.

DESCRIPTION OF THE RELATED ART

There are a number of applications in which a continuous stream of speech information is divided into signal segments in order to accommodate subsequent signal handling. For example, speech data may be segmented for storage within different tracks of a recording medium, such as a computer hard disk. As another example, voice communications between two remote sites often include segmenting speech data into packets which are transmitted via a communications link, such as a digital link. Voice digitization may produce approximately 64 Kbits of data for each second of real-time speech input. Therefore, digital speech compression techniques are utilized to increase the efficiency of the digital link. If a compression algorithm is utilized to reduce the voice data to 6.4 Kbits/s, a packet-switched 64 Kbits/s connection has the bandwidth to simultaneously support ten voice calls.

In practice, real-time speech information is digitized, compressed and packetized. Each packet may have a fixed duration. For voice communications, the fixed duration may be 5 milliseconds. Thus, the speech information is treated in the same manner as non-voice data during the signal processing.

A concern with the conventional techniques is that data packets and information within data packets may be lost, causing the quality of voice communication to be degraded. The degradation is particularly significant in some links that are susceptible to packet loss, such as a wireless connection or a local area network connection. While the speech data can be treated in much the same manner as non-speech data at the originating site, the receiving site does not have the same ability. One known technique for detecting and correcting errors for non-speech data transmissions is referred to as "checksum" error reporting. At the originating site, an algorithm is utilized to calculate a checksum number for each data packet that is transmitted to the receiving site. The checksum number identifies the content of the data packet. Each data packet and its associated checksum are transmitted to the receiving site, which utilizes the same algorithm to calculate a checksum number for each received packet. The two checksums are then compared. If the numbers are identical, the data packet is treated as being error-free. On the other hand, if the two checksum numbers are different, it is assumed that an error has been introduced during the transmission from the originating site to the receiving site. A negative acknowledgment (NAK) is transmitted to the originating site in order to initiate a retransmission of the affected data packet. Alternatively, an acknowledgment (ACK) may be transmitted from the receiving site to the originating site for each packet that is determined to be error-free. With this alternative, the originating site anticipates the ACK signal for each transmitted data packet, and if an ACK signal is not received for a particular data packet within a pre-established timeout period, the data packet is retransmitted. The receiving site typically includes a large memory buffer that enables reassembly of the data packets, despite non-sequential receptions as a result of retransmissions.

The retransmission of lost speech packets is typically not an option in real-time voice communications, since the buffering of a large number of packets would introduce noticeable delays into a conversation between persons at the two sites.

As an alternative to error correction by packet retransmission, some real-time voice transmission networks utilize error correcting encoding schemes for "repairing" speech data packets. The repair that can take place is limited, so that speech information is lost despite the error correcting encoding scheme. When the error correction fails, the speech information that is lost may include portions or all of a number of different words. The attempt to repair the packet may cause the error to be masked from the receiving party. As a result, the message may be misinterpreted.

What is needed is a method and system for processing speech information to reduce the impact of lost data upon the intelligibility of the remaining, error-free speech information.

SUMMARY OF THE INVENTION

A method and system of processing speech information include generating an electrical signal representative of a sequence of words and analyzing the signal to detect signal segments that are representative of isolated words within the sequence. In the preferred embodiment, the method and system are used to transmit the speech information to a remote site, and speech recognition techniques are employed in the detection of the signal segments representing the isolated words. In contrast to the conventional use of speech recognition techniques at an audio-presentation level, the techniques are used prior to a signal-transfer step.

At least partially based upon the detection of signal segments representative of isolated words, the electrical signal is segmented into frames of speech information. In the preferred embodiment, the data within the frames are then compressed to form data packets for transmission to a remote site. In another embodiment, the data compressed frames are stored on a recording medium, such as a computer hard disk.

Each data packet that is transmitted to the remote site preferably is associated with error checking data that accommodate error checking at the remote site. If a received data packet contains an uncorrectable error or if it is determined that a data packet has been lost, circuitry at the remote site preferably generates notice data in place of the lost speech information. The "notice data" may be a period of silence or may be a pre-determined tone that alerts the listener to the loss of speech information. Notice data are also generated if the time between consecutive arrived packets exceeds a threshold, indicating that a packet has been lost.

DETAILED DESCRIPTION

Figure 1:
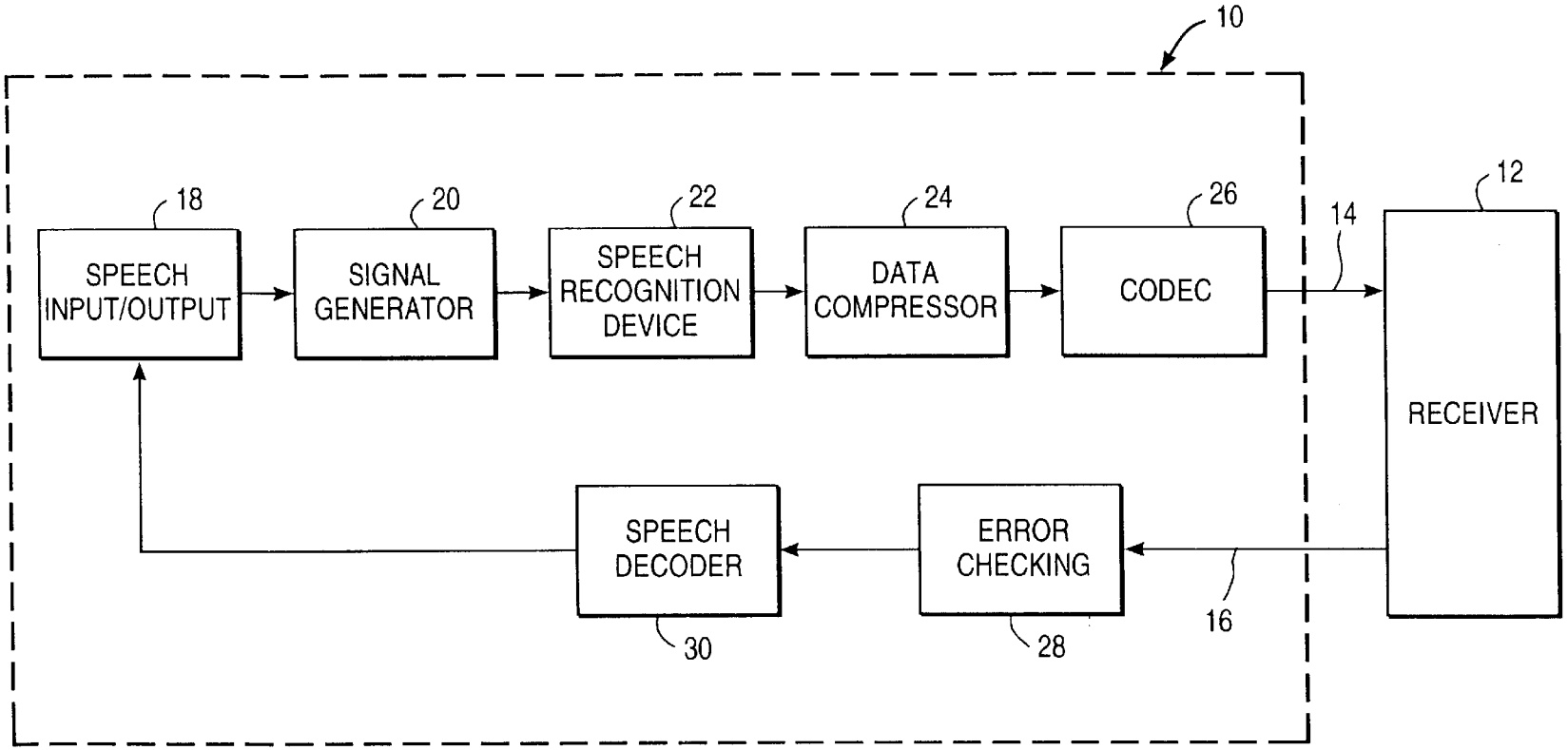
FIG. 1 is a block diagram of a system for processing speech information utilizing upstream word recognition techniques in accordance with the invention.

With reference to FIG. 1, a signal processing system 10 is shown as being connected to a receiver 12. In the preferred embodiment, the system is used for voice communications with a remote site, i.e. the receiver. For example, the system 10 and the receiver 12 may be separate sites within a local area network (LAN). Alternatively, links 14 and 16 between the system and the receiver may be wireless digital links of a cellular network.

While the signal processing system 10 is preferably used in providing real-time voice communication with a remote site, the logical speech boundary segmentation to be described below may be used in other applications. In an alternative embodiment, the receiver 12 is a storage medium, such as a computer hard disk. Digital data may be stored in packets that are determined by speech content. For example, each packet may contain data representative of a single word in a logical sequence of words. That is, the segmentation of a signal that is generated in response to a speech input is content based, rather than time based. The time-based segmentation typical of conventional systems disregards the signal content and forms data frames that are generally equal in duration, e.g. 5 milliseconds.

The signal processing system 10 of FIG. 1 includes a speech input/output device 18. The input/output device may be a telephone. A signal generator 20 is connected to the speech input/output device to form an electrical signal in response to speech. In one embodiment, the signal generator is an analog-to-digital converter having an input from an analog speech input/output device 18. In another embodiment, the input/output device 18 and the signal generator 20 are a single unit that provides an analog or digital signal to downstream processing circuitry.

A continuous stream of speech information is input to a speech recognition device 22. That is, real-time voice information is received at the speech recognition device. The device analyzes the signal to detect signal segments representative of logical speech boundaries, providing the basis for segmenting the signal. Preferably, each signal segment defined by analysis at the speech recognition device includes the signal components which comprise an isolated word. However, in some embodiments, there may be advantages to including more than one complete word within a signal segment. Similarly, there may be applications in which each signal segment comprises the speech information associated with a single syllable, so that the segmentation is implemented on a syllable-by-syllable basis.

The signal analysis at the speech recognition device 22 may be implemented using known algorithms. Identifying particular words is not critical to some applications of the invention, since logical speech boundaries are of interest. If the segmentation is implemented on a syllable-by-syllable basis, the input signal is a time-varying speech signal and the algorithm is required to only distinguish portions of the signal that include speech from portions having silence. Thus, an intensity threshold may be designated and any portions of the speech signal having an intensity greater than the threshold may be identified as the "speech," while portions having a signal intensity less than the threshold may be identified as "non speech." However, the speech recognition device 22 preferably is able to identify particular words, so that words remain intact during a subsequent step of packetizing the signal for transfer to the receiver 12.

For occasions in which the speech recognition device 22 cannot identify word boundaries for a significant period of time, a fixed timing frame may be implemented. That is, the signal segments may be limited in duration by imposing a pre-established threshold, e.g., 250 milliseconds. In such a situation, the quality of speech provided by the signal processing system 10 will be equivalent to that achieved using prior techniques.

The output from the speech recognition device 22 is transferred to a data compressor 24. The incoming digital voice signal is compressed, with each frame preferably containing a single word. In some embodiments of the invention, data compression is optional. For applications in which compression is employed, the specific compression algorithm is not critical to the invention, and will depend upon the application.

A codec 26 encodes the compressed data frames from the data compressor 24 to form packets for transfer to the receiver 12. Preferably, the data packets are encoded to allow error checking. If the signal processing system 10 is one site of a network having an error detection and correction scheme, the codec 26 follows the scheme. On the other hand, if no error correction and detection scheme is implemented on a network level, a simple checksum process may be employed. That is, an algorithm may be utilized to calculate a checksum number for each data packet that is transmitted to the receiver 12. Prior to decoding at the receiver 12, the same algorithm may be used to calculate a checksum number for each received packet. If the two checksum numbers are identical, the data packet is presumed to be error-free. On the other hand, if the two checksum numbers are different, it is assumed that a transmission error has been introduced. Preferably, the listener at the receiver is alerted when speech information is lost. As will be explained more fully below, notice data may be generated to introduce silence or a tone into the received speech.

As previously noted, the receiver 12 may be a recording medium, but preferably is a remote site having reception and transmission capabilities. When the signal processing system 10 is in a receive or readback mode, the digital link 16 inputs a signal to error checking circuitry 28. With checksum error checking, the checksum numbers are compared at the circuitry 28. However, error checking is not critical to the invention. The speech information is passed to a decoder 30 that utilizes known techniques for formatting the speech information in order to accommodate voice presentation at the speech input/output device 18. The decoding operation depends upon the encoding scheme of the received packets and upon the type of input/output device, e.g., an analog or a digital telephone or audio equipment of a video conferencing station.

Figure 2:
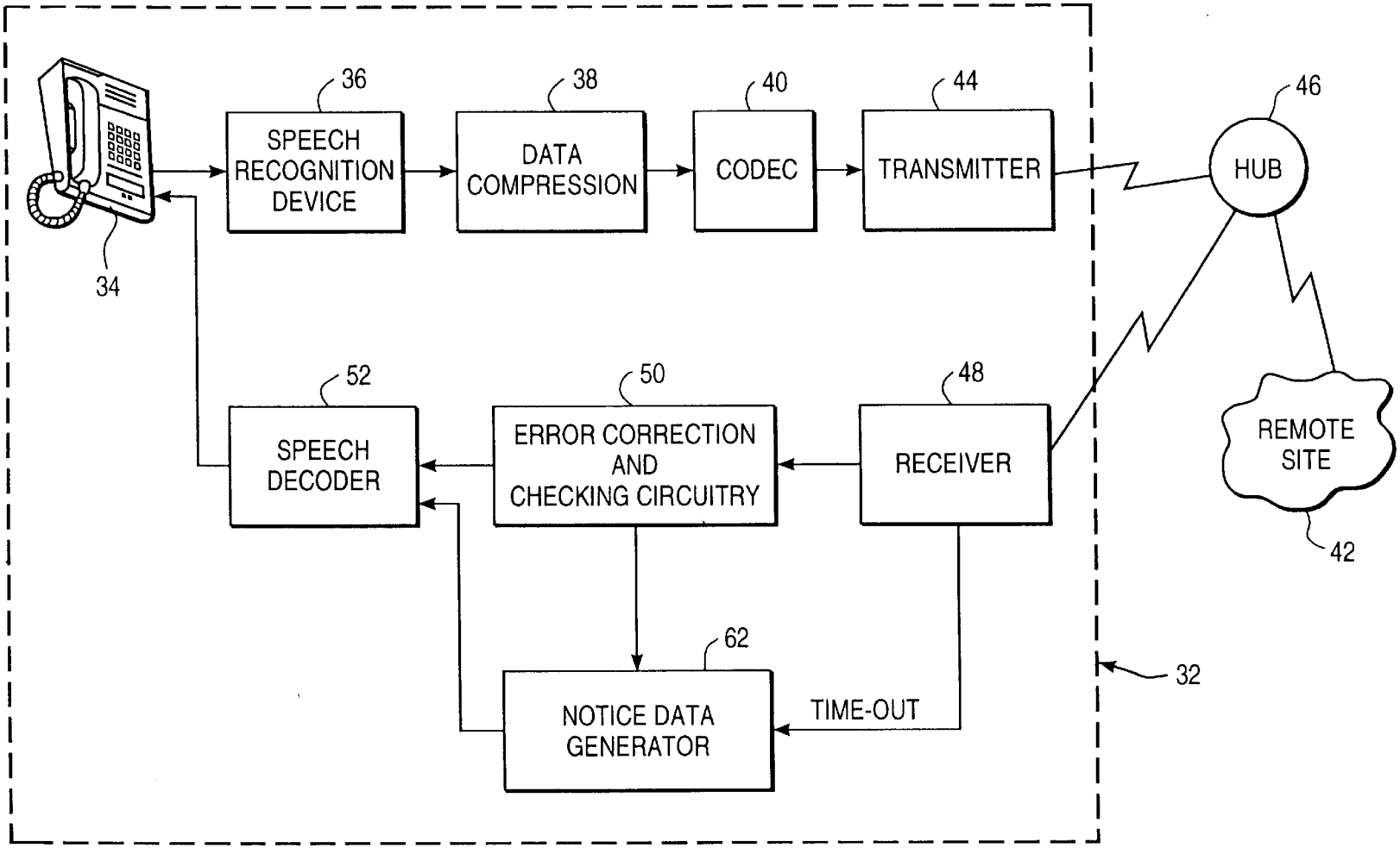
FIG. 2 is a block diagram of the system of FIG. 1 in a telephone network application.

A more detailed and preferred embodiment of a signal processing system 32 is shown in FIG. 2. A telephone 34 provides an input to a speech recognition device 36. The speech recognition device detects logical speech boundaries within the input signal and designates frames based upon the speech boundaries. For example, each frame may include the speech information for a single word. If no word boundary has been detected within a preselected duration, a frame boundary is defined. In one embodiment, the preselected duration threshold is 250 milliseconds. Thus, each frame that is defined by the signal processing system 32 will be the lesser of 250 milliseconds and the duration of the detected speech element, e.g., a word.

A data compression device 38 and a codec 40 compress the data within each frame and implement any desired encoding to provide data packets for transfer to a remote site 42 by means of a transmitter 44. As noted with reference to FIG. 1, data compression is optional to some embodiments of the invention. In the embodiment of FIG. 2, the signal processing system 32 and the remote site 42 are devices within a cellular network, with the transmission being made via a hub 46.

For a voice message from a person at the remote site 42 to a person at the signal processing system 32, the hub 46 forwards the message from the remote site to a receiver 48 at the system 32. The message is forwarded in data packets of compressed speech information. Each data packet is directed to optional error correction and checking circuitry 50. Error correction is not a critical feature of the invention. If error correction is implemented, any known techniques may be employed. In one embodiment, checksum techniques are utilized.

Data packets that are determined to be error-free are passed from the error correction and checking circuitry 50 to the speech decoder 52. Depending upon the error correction techniques used within the system 32, the error-free packets may also be stored for potential utilization in the correction scheme. Packets that are determined to have corrupt data are "repaired," if possible.

Packets which are not correctable are forwarded to a notice data generator 62. The notice data generator provides a packet having signal characteristics which are designed to alert a listener at the telephone 34 that speech information has been lost. For example, a single frequency tone may be injected into the decoded speech information that is presented to the listener at the telephone 34. Alternatively, the notice to the listener may be a silent period. The notification allows the listener to request "retransmission" of the message from the person at the remote site 42. The "retransmission" is a verbal request to repeat missed information.

In the preferred embodiment, if the period between reception of two consecutive data packets from the remote site 42 is longer than a pre-established threshold, the system assumes that the packet has been lost in the network transmission. An acceptable threshold is 5 milliseconds, but the preferred threshold value will depend upon the application. When the threshold has been exceeded, a time-out signal is sent to the notice data generator 62 on path 66. A notice data packet is generated and sent to the speech decoder 52 for injection into the voice stream in place of the missing packet, thereby alerting the listener that information has been lost.

Figure 3:
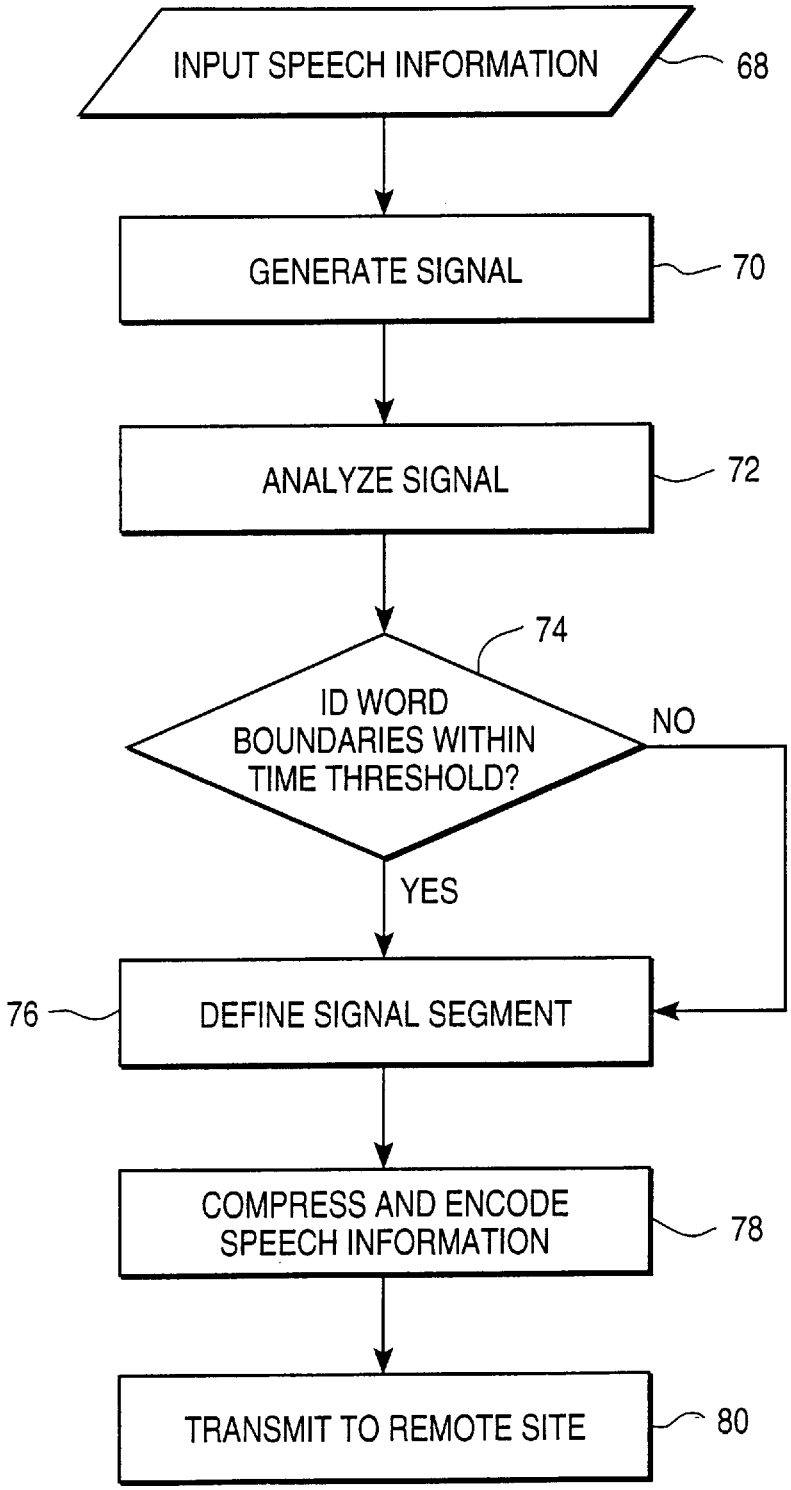
FIG. 3 is a process flow of steps for utilizing the system of FIG. 2 in a transmit mode.

The process steps for operating the signal processing system 32 of FIG. 2 in a transmit mode are shown in FIG. 3. In step 68, speech information is input to the system. In FIG. 2, the speech input device is shown as a telephone 34, but this is not critical.

In step 70, an electrical signal is generated in response to the speech input. The signal may be an analog signal, but digital signal processing is preferred. The signal is analyzed in step 72 using a speech recognition algorithm. Logical speech boundaries are identified by the signal analysis. In a preferred embodiment, the boundaries isolate single words within the speech information. However, the isolation may be on a syllable-by-syllable basis rather than on a word-by-word basis. As another alternative, the boundaries may isolate more than one word in a signal segment, but without dividing words.

The decision step 74 is included for instances in which the speech recognition algorithm is unable to distinguish words. This may be a result of an inability by the speech recognition algorithm or may be a result of the input. For example, a long pause between words or sentences will result in an extended signal segment unless a time threshold is established to limit the duration of the signal segments. An acceptable time threshold is 250 milliseconds. If a logical speech boundary is identified within the 250 milliseconds, a signal segment (i.e., a frame) is defined at step 76. If a logical speech element is not isolated within the time threshold, the decision step 74 automatically triggers the definition of a signal segment at step 76.

In step 78, the speech information is compressed and encoded. Known compression and encoding schemes may be utilized. The encoding may include error correction information. The resulting packets are transmitted in step 80 to a remote site. Because each packet has dimensions defined by logical speech boundaries, loss of a single packet is less likely to cause a misinterpretation at the receiving site 42. This is particularly true if the receiving site includes means for generating notice data in response to detection of lost data.

Figure 4:
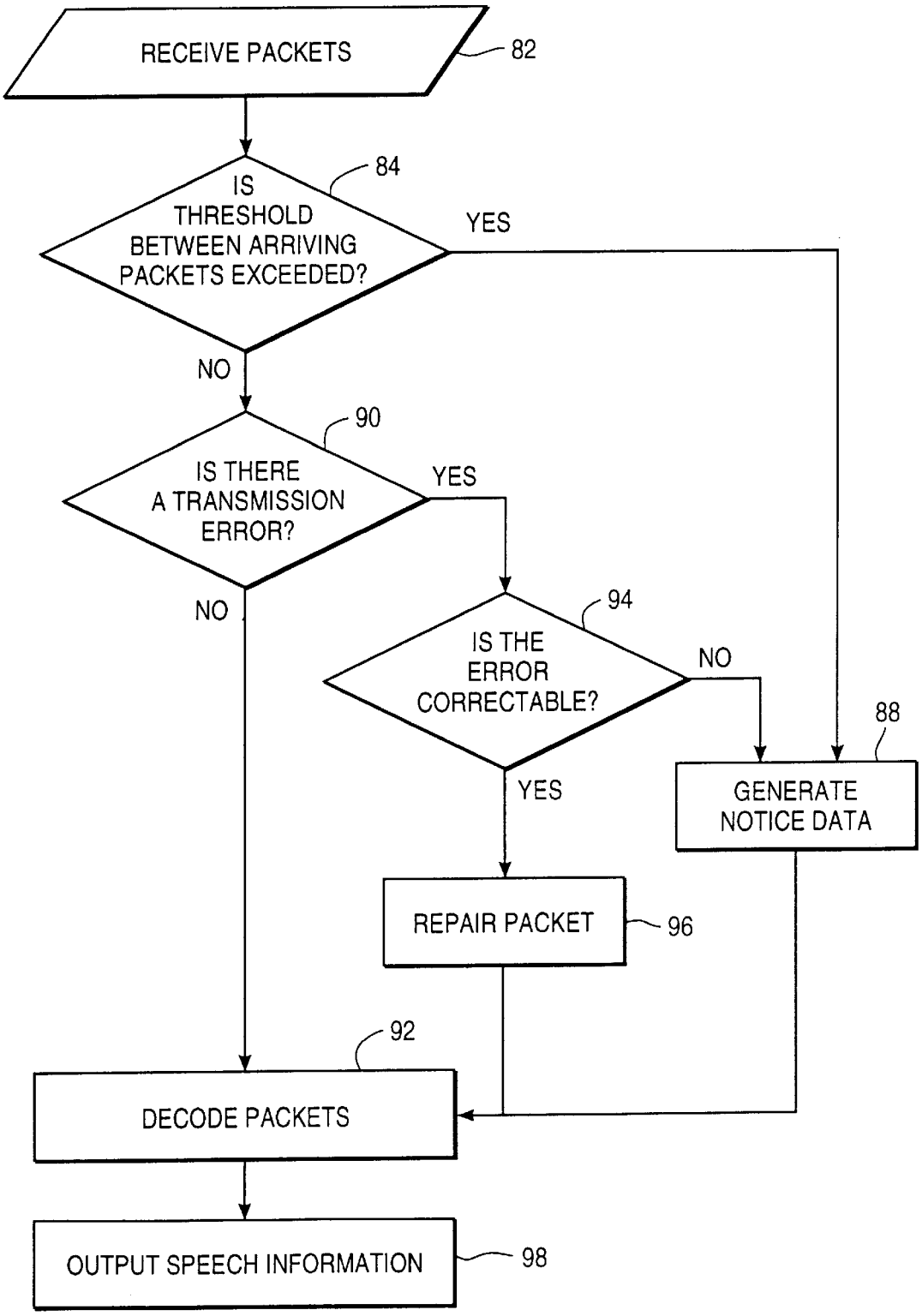
FIG. 4 is a process flow of steps for utilizing the system of FIG. 2 in a receive mode.

The receive operation of the signal processing system 32 will be described with reference to FIG. 4. In step 82, packets of compressed speech information are received from the remote site 42. As previously noted, a threshold duration may be set between consecutive packets. If the threshold duration is exceeded, it is assumed that a packet has been lost during transmission. In FIG. 4, a decision step 84 is included to implement the threshold monitoring. All received packets are passed to an error correction and checking process (when one is utilized), but if the threshold duration is exceeded between consecutive packets, a step 88 of generating notice data is triggered. The notice data has signal characteristics that will alert a listener to the fact that data has been lost.

The error correction and checking process is executed using known techniques, such as checksum number comparison. If at step 90 it is determined that there is no transmission error, packets are passed to the decoding step 92 that receives the notice data generated at step 88. Packets that are identified as having transmission errors are passed to step 94, in which it is determined whether the error is correctable. Packets having a correctable error are repaired at step 96 and passed to the decoding step 92. Uncorrectable errors trigger generation of notice data at step 88, with the notice data being forwarded to the decoding step for proper placement within a continuous stream of speech information that is output at step 98. The notice data alerts the listener that some speech information is missing. This allows the listener to request that the speaker at the remote site 42 repeat the message or provide a clarification.

Because the invention handles voice data in logical increments (e.g., words), if a packet is lost, speech information will be presented to a listener with a missing logical increment. The resulting speech will be less garbled than if random-sized pieces of words were missing. Since voice packets can be sequentially numbered, a skipped packet can be replaced with the above-mentioned notice data for alerting the listener that speech information is missing.

While the invention has been described and illustrated primarily with regard to transmission of speech data to and from a remote site, this is not critical. In another embodiment, the receiver 12 in FIG. 1 is a storage medium, such as a computer hard disk. Thus, with the exception of the steps of transmitting and receiving data over communication lines, all of the steps described above apply equally to the computer storage application.

What is claimed is:

1. A method of processing speech information comprising steps of:

converting analog voice signals representative of sound of a sequence of spoken words into digital voice signals representative of said sound of said sequence of spoken words;

analyzing said digital voice signals representative of said sound of said sequence of spoken words to detect signal segments representative of isolated words within said sequence of spoken words;

segmenting said digital voice signals representative of said sound of said sequence of spoken words at least partially based upon said detection of said signal segments representative of isolated words, thereby forming frames of digital voice signals; and data compressing said digital voice signals within said frames, said compressed digital voice signals within said frames having phonetic information that substantially preserves individual sounds of said isolated word a within said sequence of spoken words.

2. The method of claim 1 further comprising steps of forming said frames of data compressed digital voice signals into packets and transmitting said packets to a remote site.

3. The method of claim 2 further comprising steps of receiving packets of data compressed digital voice signals from said remote site and error checking said received packets.

4. The method of claim 3 further comprising steps of data decompressing said digital voice signals of said received packets to form a stream of digital voice signals and injecting notice data indicating detection of a transmission error into said stream at a place in said stream of digital voice signals where said step of error checking determines that digital voice signals have been lost.

5. The method of claim 4 wherein said step of injecting notice data indicating detection of a transmission error includes generating continuous-tone data.

6. The method of claim 2 further comprising steps of receiving packets of data compressed digital voice signals from said remote site and detecting when a packet has been lost in transmission from said remote site, including decompressing said data compressed digital voice signals of said received packets to form a continuous stream and injecting notice data indicating detection of a transmission error into said stream in place of a packet that has been lost in transmission.

7. The method of claim 2 further comprising storing said packets of data compressed digital voice signals on a recording medium.

8. The method of claim 1 wherein said step of segmenting includes establishing a time threshold and includes forming said frames based upon limiting each frame to containing the lesser of data specific to an isolated word of said sequence of words and data generated during passage of said time threshold.

9. The method of claim 1 wherein said step of segmenting said digital voice signals representative of the sound of said sequence of words is a step of segmenting said digital voice signals by word, thereby forming single-word frames of data compressed digital voice signals, and further comprising the steps of forming each one of said single-word frames of data compressed digital voice signals into separate single-word packets, and transmitting said single-word packets to a remote site.

10. A method of processing speech information for real-time voice communications comprising steps of:

generating digital voice signals from analog voice signals in response to a voice input of a sequence of words, said digital voice signals containing phonetic information that is representative of individual sounds of said voice input;

analyzing said digital voice signals to recognize logical speech boundaries relating to said sequence of words;

establishing signal segments of said digital voice signals based upon said logical speech boundaries and a threshold time, including forming said signal segments based upon limiting each signal segment to containing the lesser of data specific to a detected isolated word contained in said voice input that is defined by said logical speech boundaries and data generated during passage of said threshold time;

compressing said digital voice signals within each of said signal segments of said digital voice signals, said compressed digital voice signals within each of said signal segments being in a form to substantially preserve said phonetic information that is representative of said individual sounds of said voice input; and transmitting said signal segments of said compressed digital voice signals to a remote site.

11. The method of claim 10 wherein said step of transmitting includes packetizing said signal segments of said compressed digital voice signals such that each signal segment is associated with a packet.

12. The method of claim 11 further comprising a step of attaching error checking data to each packet to accommodate error checking at said remote site.

13. The method of claim 10 further comprising receiving digital voice signals from said remote site in said signal segments, including implementing error checking to detect lost signal segments and injecting notice data indicating detection of a transmission error in place of a lost signal segment.

14. A system for processing speech information comprising:

a speech input device for receiving an analog voice input;

a signal generator responsive to said speech input device for forming digital voice signals at an output, said digital voice signals containing phonetic information that is representative of individual sounds of said analog voice input;

speech recognition means coupled to said output of said signal generator for detecting signal segments within said digital voice signals that represent isolated words, said speech recognition means being configured to form said signal segments based upon limiting each signal segment to containing the lesser of data specific to an isolated word contained in said analog voice input and data generated during passage of a threshold time, said speech recognition means maintaining said digital voice signals as containing said phonetic information that is representative of said individual sounds of said analog voice input; and compression means, connected to said speech recognition means, for compressing said digital voice signals that are within said signal segments while maintaining said digital voice signals to contain said phonetic information that is representative of said individual sounds of said analog voice input.

15. The system of claim 14 further comprising a transmitter connected to said compression means for transferring said signal segments of compressed digital voice signals to a remote site.

16. The system of claim 15 further comprising a receiver connected to receive signal segments from said remote site, said receiver having error checking means for detecting a missing signal segment.

17. The system of claim 16 wherein said speech input device is a telephone.

* * * * *